US008807270B2

(12) United States Patent
Givre

(10) Patent No.: US 8,807,270 B2
(45) Date of Patent: Aug. 19, 2014

(54) LOUDSPEAKER CABINET WITH A DEVICE FOR MECHANICAL CONNECTION TO ANOTHER CABINET AND/OR A DEVICE FOR ADJUSTING THE INTER-CABINET ANGLE

(71) Applicant: Nexo, Plailly (FR)

(72) Inventor: Christophe Givre, Bussy-Saint-Georges (FR)

(73) Assignee: Nexo, Plailly (FR)

( * ) Notice: Subject to any disclaimer, the term of this patent is extended or adjusted under 35 U.S.C. 154(b) by 0 days.

(21) Appl. No.: 13/836,170

(22) Filed: Mar. 15, 2013

(65) Prior Publication Data

US 2013/0240288 A1 Sep. 19, 2013

(30) Foreign Application Priority Data

Mar. 16, 2012 (FR) ..... 12 52414

(51) Int. Cl.
*A47B 81/06* (2006.01)

(52) U.S. Cl.
USPC ..... 181/199; 181/30

(58) Field of Classification Search
CPC ..... H04R 1/02; H04R 1/021; H04R 1/023; H04R 1/026
USPC ..... 181/199, 30
See application file for complete search history.

(56) References Cited

U.S. PATENT DOCUMENTS 5,758,852 A * 6/1998 Martin ..... 248/282.1
5,819,959 A * 10/1998 Martin ..... 211/118
7,261,180 B1 * 8/2007 Faranda et al. ..... 181/199
7,298,860 B2 * 11/2007 Engebretson et al. ..... 381/386
7,328,769 B1 * 2/2008 Adamson ..... 181/199
7,415,124 B2 * 8/2008 Colich ..... 381/335
7,634,100 B2 * 12/2009 Monitto et al. ..... 381/386
7,967,103 B2 * 6/2011 Bothe ..... 181/199
8,590,666 B2 * 11/2013 Adamson et al. ..... 181/199
2002/0121847 A1 * 9/2002 Christner ..... 312/111
2008/0170735 A1 * 7/2008 Engebretson et al. ..... 381/335
2009/0022354 A1 * 1/2009 Parker ..... 381/395
2012/0189420 A1 * 7/2012 Kemper et al. ..... 414/800

FOREIGN PATENT DOCUMENTS

CN 2 448 899 9/2001
FR 2 250 370 5/1975

OTHER PUBLICATIONS

French Search Report dated Jun. 5, 2012, corresponding to the Foreign Priority Application No. 1252414.

* cited by examiner

*Primary Examiner* — Forrest M Phillips
(74) *Attorney, Agent, or Firm* — Young & Thompson

(57) ABSTRACT

A loudspeaker cabinet (2) includes a device for mechanical connection to another loudspeaker cabinet and/or a device (8) for adjusting an angle formed between the cabinet (2) and the other cabinet. The connection device includes a mechanism for the conversion of a translational actuation control in a first direction into a translational movement of at least one first latch in a second direction different from the first direction. The angle adjustment device includes an element (8) the length of which in the operating position adjusts the angle and is determined according to the position of a rotary component (10).

17 Claims, 14 Drawing Sheets

LOUDSPEAKER CABINET WITH A DEVICE FOR MECHANICAL CONNECTION TO ANOTHER CABINET AND/OR A DEVICE FOR ADJUSTING THE INTER-CABINET ANGLE

FIELD OF THE INVENTION

The invention relates to a loudspeaker cabinet with a device for mechanical connection with another cabinet and/or a device for adjusting the inter-cabinet angle.

BACKGROUND OF THE INVENTION

Assembling professional sound system cabinets in columns (or "line arrays") has been common for more than 10 years. These assemblies can be constituted by several tens of cabinets, each weighing more than 50 kg.

Rigging systems have therefore been proposed that can be divided into two categories: frames (or "bumpers") that connect the upper cabinet to the hoisting motors, and the mechanical components for rigging each cabinet that connect the cabinets together.

Most inter-cabinet rigging systems have the following features:

- the cabinets are rigged using a tension mounting method, in which case the cabinets are brought to their final angles by the force of gravity, or using a compression mounting method, in which case a return force applied at the bottom of the assembly brings the cabinets to their final angles;
- they are 4-point systems, which results in an overstress in the definition of one plane such that the fourth point is always difficult to connect;
- they use ball locks or quick-release pins and the tolerance of the holes receiving these ball locks must accordingly be defined extremely strictly (if the hole is too small, the pin does not enter; if it is too large, the pin is not retained);
- said pins provide both the inter-cabinet connection and the adjustment of inter-cabinet angles (the angles are generally adjusted to between 0 and 10°), which makes the system and its assembly more complex, inasmuch as the angle adjustments must be identical on each side of the cabinets;
- the ball locks are parts that are separate from the cabinet and can be easily lost.

These difficulties are magnified if the cabinets are tension-mounted, as the method of rigging the cabinets implies manually lifting the rear thereof in order to insert the ball locks in the holes corresponding to the required angle values between the cabinets.

Consequently, these current systems are complex to assemble and require at least 2 to 3 experienced technicians. Such an assembly furthermore needs precious time when carried out for a concert taking place the same evening.

Moreover, the solutions described in U.S. Pat. Nos. 7,328,769, 7,298,860 and 7,634,100 are known.

In this context, the invention proposes a loudspeaker cabinet comprising a device for mechanical connection with another loudspeaker cabinet, characterized in that the connection device comprises a mechanism for converting a translational actuation control in a first direction into a translational movement of at least one first latch in a second direction different from the first direction.

The actuation control can thus in particular be positioned in an easily-accessible place on the cabinet. Similarly, the movement carried out by the operator to activate the actuation control can thus be made in a direction that is desirable in practical terms (and not necessarily in the direction of displacement of the latch).

The conversion mechanism can moreover convert the translational actuation into a translational movement of a second latch, making it possible to drive two locking points from a single actuation control.

The translational movement of the second latch is for example in the second direction with a direction opposite to the translational movement of the first latch, allowing the simultaneous connection of the two opposite sides of the cabinet by means of the abovementioned actuation control.

The conversion mechanism can comprise in practice a cam driven by said actuation control. Such a cam makes it possible to implement the change of direction, as well as optionally the gearing down or up of the movement, by choosing in particular a suitable cam path.

The cam defines for example a cam path suitable for guiding a pin firmly fixed to the latch; it is then possible to provide for the cam path to comprise an indentation in which the pin is immobilized by means of a spring. The combination of the cam and the spring thus makes it possible to lock the mechanism in a given position.

The first direction is for example essentially perpendicular to the second direction, which gives a particularly practical configuration, as in the example described hereinafter. It is possible however to provide in a variant for the first direction and the second direction to form a (non-zero) angle between them different from a right angle.

The actuation can be carried out by a handle. It is then possible to provide a mechanism for automatically locking the handle (in its position corresponding to a connected position of the latch). The handle is then locked automatically (i.e. without action by the operator on the locking mechanism, for example when the latter brings the handle into a position in which the cabinet is connected to the other cabinet by means of the latch) as soon as the cabinets are connected; unlocking it, on the other hand, requires specific action by the operator on the locking mechanism, as explained hereinafter, which provides additional safety.

The invention provides moreover, optionally independently of the foregoing, a loudspeaker cabinet comprising a device for adjusting an angle formed between the cabinet and another cabinet, characterized in that it comprises an element the length of which in the operating position adjusts said angle and is determined according to the position of a rotary component, for example adjustable by the user, typically by rotation of the rotary component by the user. The use of such a rotary component considerably simplifies the adjustment of the length of the element and as a result, that of the inter-cabinet angle. The user can thus turn the rotary component to its desired position, which determines the length of the element in the operating position.

The element is for example a piston comprising a rod slidably mounted in a body and the rotary component can then be a wheel rotatably mounted about a main axis of the piston.

As explained below, a cabinet will then be for example firmly fixed to the body while the other cabinet will be for example attached to the rod (optionally using a ball lock) so that the adjustment of the piston length in its operating position makes it possible to adjust the inter-cabinet angle.

Provision can be made for example for the piston to be in compression in said operating position, as is the case in the embodiment described hereinafter.

According to another possibility, the piston can however be in tension in said operating position, as in the variant given at the end of the following description.

A device can moreover be provided for locking the rod in a position of maximum extension with respect to the body, making it possible to stack several cabinets on a dolly for transport purposes while keeping them flat.

A device can also be provided for locking the rod in a retracted position in the body, allowing the piston to be stored in the body, within the height of the cabinet.

The abovementioned angle adjustment can be done around a retractable shaft provided in the cabinet for connection to the other cabinet.

A mechanism can be provided in this context for the conversion of a translational actuation in a first direction into a translational movement of at least one first latch in a second direction different from the first direction, as disclosed above. The retractable shaft can then include said first latch.

BRIEF DESCRIPTION OF THE DRAWINGS

This conversion mechanism can optionally incorporate one or more of the abovementioned optional features for the conversion mechanism proposed by the invention.

Further features and advantages of the invention will become apparent in the light of the following description, given with reference to the attached drawings, in which:

FIGS. 1 and 2 show a loudspeaker cabinet 2 that comprises in particular the following three devices, mechanically associated with each other:

Figure 1:
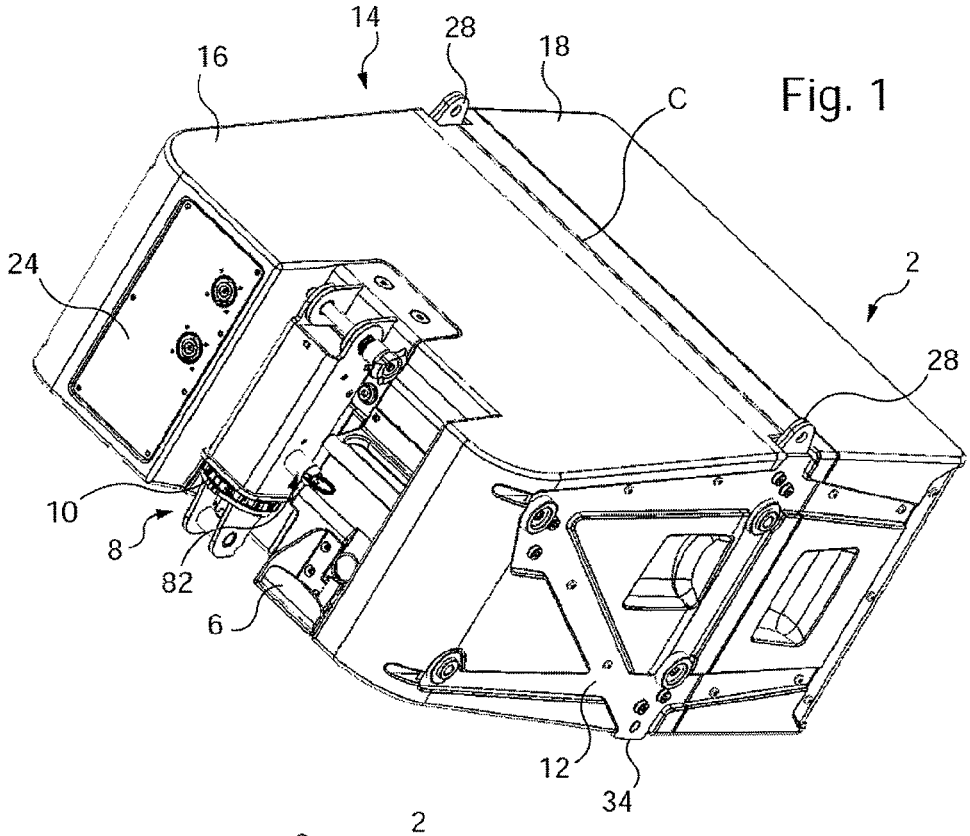
FIG. 1 shows a perspective view of a loudspeaker cabinet according to the teaching of the invention.

- a "T" assembly 4 housed under the cabinet and comprising a mechanism that converts a depth wise translational movement of a handle 6 arranged at the rear of the cabinet into lateral movements each driving a side latch (referenced 5 in FIG. 3);
- a piston 8, here a single piston, which provides the rear connection to another cabinet, as well as the angle adjustments between the cabinet 2 and said other cabinet: the upper portion of the piston is captive within the cabinet, the lower portion is connected to the lower cabinet by a single ball lock. A toothed wheel 10, rotatably mounted about the axis of the piston 8 and the position of which is for example marked by letters, allows pre-adjustment of the piston length (once the cabinets are assembled as explained below) and therefore of the inter-cabinet angle;
- a metal bumper 12 that ensures the rigidity of the assembly: metal continuity top-to-bottom (for the forces of gravity in play on the narrow angles) and front-to-back (for the transfers of force in the case of a wide angle).

Apart from these structural assemblies, the cabinet 2 comprises outer walls, namely in particular an upper wall 14, a lower wall 20, side walls 22, a rear wall 24 configured to receive the piston 8 in an indentation of this wall.

The front face of the cabinet 2 is itself closed by a grille 26 in order to allow the emission of the sound waves.

The upper wall 14 comprises a front portion 18 that is essentially planar and a rear portion 16 that is essentially planar and slightly inclined with respect to the front portion 18.

In the example shown, the front portion 18 is almost horizontal (i.e. almost parallel to the direction of acoustic emission of the cabinet), and the rear portion 16 is inclined according to the maximum half-value envisaged for the inter-cabinet angle.

In the front region of the rear portion 16 of the upper wall 14, two lugs 28 extend beyond the upper wall 14, the lugs 28 being situated each at a lateral end of the upper wall 14.

As also explained hereinafter, the lugs 28 originate from (i.e. are mechanically connected to) the bumper 12 and are intended to receive the latches of another cabinet designed for example like the cabinet in FIG. 1 and mounted in contact with the cabinet 2 at the level of a hinge line C extending between the two lugs 28, specifically between the centres of the holes of the lugs 28. The lugs are situated at the level of the junction between the front portion 18 and the rear portion 16.

The lower wall 20 also comprises a front portion 21 that is essentially planar (and here almost horizontal), and a rear portion 19, also essentially planar and slightly inclined with respect to the front portion 21 (again in the present case according to the maximum half-value envisaged for the inter-cabinet angle).

The T-assembly 4 is mounted on the cabinet 2, in particular on the rear portion 19 of the lower wall 20 so that a lower surface of the T-assembly 4 extends in the plane of the rear portion 19 of the lower wall 20, i.e. the T-assembly does not extend beyond the surface defined by the rear portion 19 of the lower wall 20. It is noted that the T-assembly 4 (in particular its transverse portion 32 described hereinafter) forms the junction between the front portion 21 and the rear portion 19.

As will be described in greater detail below, the T-assembly 4 comprises an axial portion 30 and a transverse portion 32. The axial portion 30 extends essentially in the direction of acoustic emission, although in the plane of the rear portion 19 of the lower wall 20, between the handle 6 and the transverse portion 32.

It is noted that the handle 6 here extends preferably at the level of the rear end of the lower wall 20 so that it can be operated easily from the rear of the cabinet.

The transverse portion 32 extends perpendicularly to the axial portion 30, over almost the entire width of the rear portion 19 of the lower wall 20, and bears at each end a removable latch, as explained below.

The T-assembly 4 is moreover situated at the level of the lower wall 20 so that each end of its transverse portion 32 bearing the latches 5 is situated at the level of two parallel tabs 34, 36 originating from the bumper 12.

Each tab 34, 36 bears a hole 38 in which the neighbouring latch 5 (borne by the transverse portion 32 of the T-assembly 4) can be lodged in the deployed position.

Figure 3:
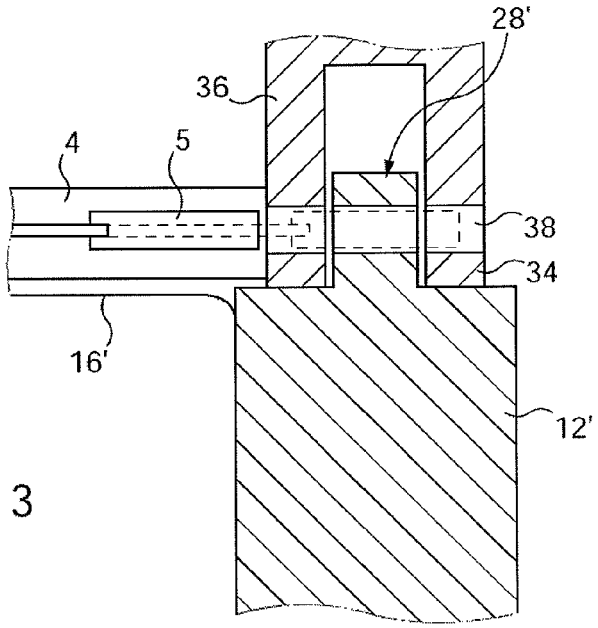
FIG. 3 shows in detail an assembly point of two cabinets.

FIG. 3 shows the connection between two cabinets by means of the tabs 34, 36 and the T-assembly 4 of a cabinet, and the lug 28' of another cabinet.

FIG. 3 shows that once the two cabinets are arranged in contact with each other (i.e. when the hinge line C of one of the cabinets is arranged in line with the transverse portion 32 of the T-assembly 4 of the other cabinet), the orifice of the lug 28' is situated in line with each of the orifices 38 of the tabs 34, 36 of the other cabinet so that the latch 5 can then be displaced (as explained hereinafter) in the deployed position, where it is positioned at the level of the orifices 38 of its own cabinet, and as a result passes through the orifice of the lug 28'.

Such an assembly is carried out at each lateral end of the assembly of the two cabinets so that they are connected together at the level of an axis, here the axis linking the two latches 5 (defined above as the hinge line C).

Figure 4:
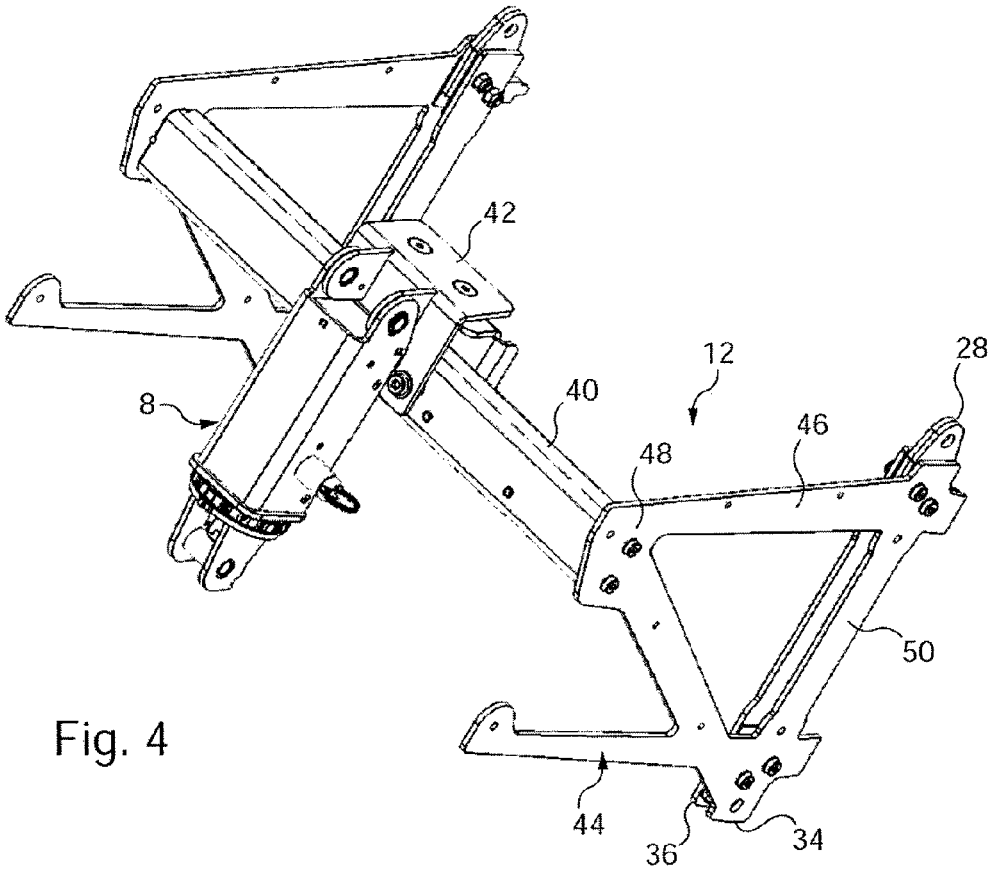
FIG. 4 shows the bumper and piston of the cabinet in FIG. 1.

FIG. 4 shows the bare bumper (i.e. without the walls of the cabinet), on which the piston 8 is mounted.

The bumper 12 comprises a main crossmember 40 that bears at its centre a bracket 42 intended to bear rotatably the upper portion of the piston 8.

The crossmember 40 is mounted at each of its ends on a side portion 44 of the bumper 12.

Each side portion 44 extends essentially in a plane that corresponds generally to that of the corresponding side wall 22 and is therefore essentially perpendicular to the general direction of the crossmember 40.

Each side portion 44 of the bumper 12 comprises a triangular structure 46, which receives at an apex of the triangle formed thereby, fasteners of the cross-member 40 and the side 50 of which opposite the apex 48 mechanically links the lug 28 to the tabs 34, 36 already mentioned.

Due to its location between the inter-cabinet connection assemblies (lug 28, tabs 34, 36 as explained above), provision can be made for this portion 50 of the triangular structure 46 to be reinforced, for example by producing it in the form of two parallel rails, as shown in FIG. 4.

Figure 5:
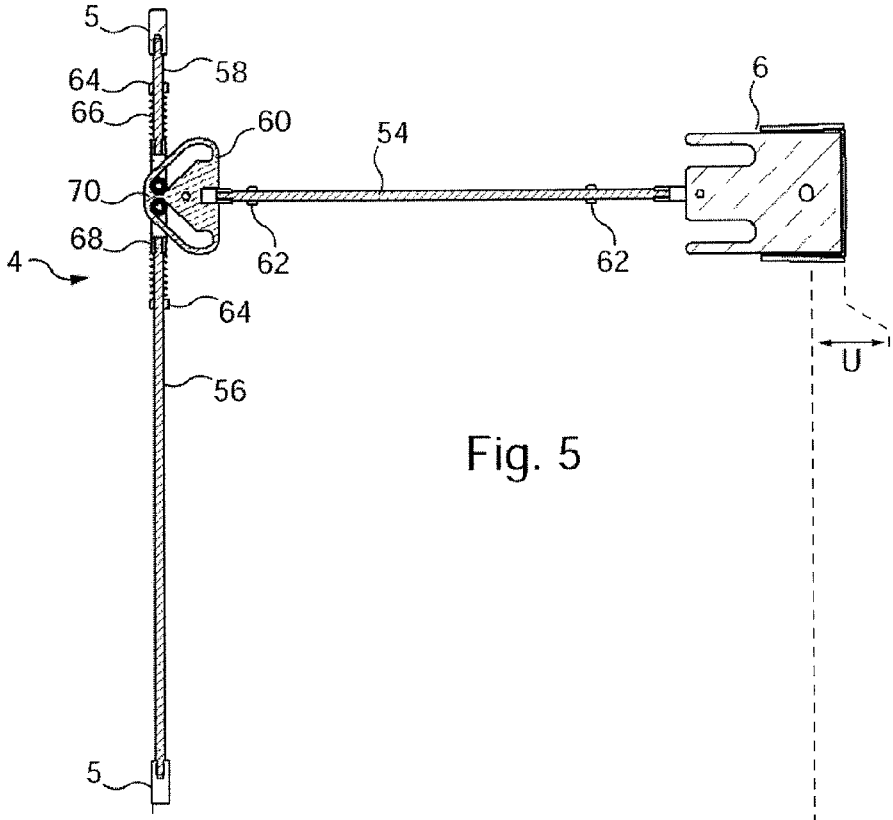
FIG. 5 shows a latch actuation mechanism when the latches are in the retracted position.
Figure 6:
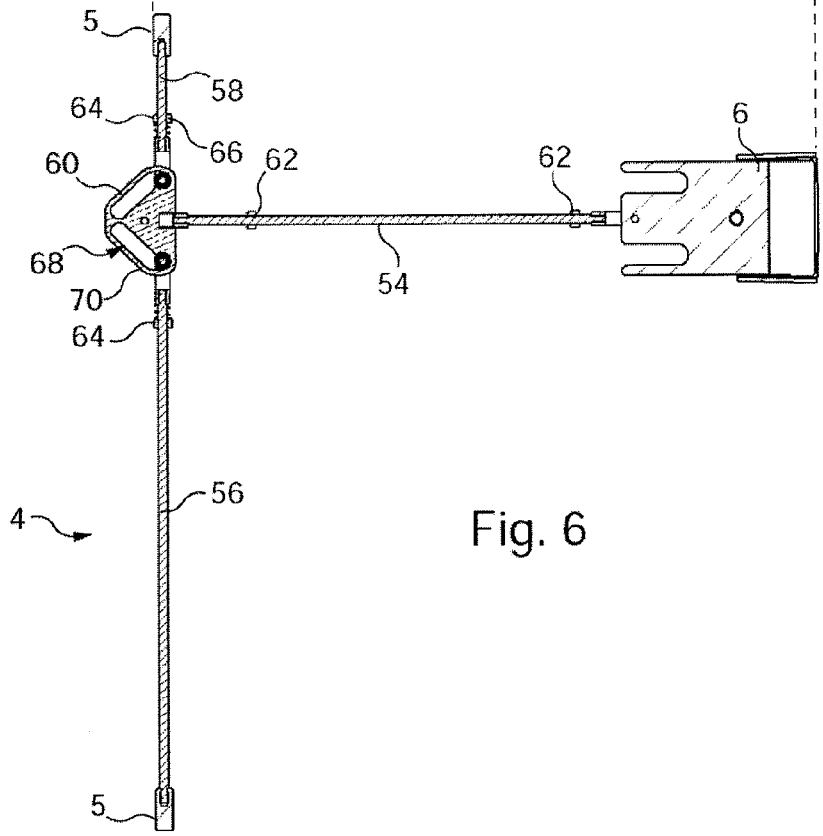
FIG. 6 shows the mechanism in FIG. 5 when the latches are in the deployed position.

FIGS. 5 and 6 show in cross-section the rod linkage mechanism of the T-assembly 4 that makes it possible as already stated, to convert the movement of the handle 6 in the direction of the depth of the cabinet (i.e. in the general direction of emission thereof), into a lateral movement for each latch 5, i.e. here specifically a movement perpendicular to the displacement of the handle 6 in the plane of the T-assembly 4 (i.e. as already stated the plane formed by the rear portion of the lower wall 20 of the cabinet 2).

FIG. 5 shows this mechanism when the handle 6 is situated in its rearmost position and each of the latches 5 is therefore retracted, while FIG. 6 shows the mechanism when the handle 6 is in its foremost position and the latches 5 are therefore fully deployed and can therefore lock the assembly of two cabinets, as explained above with reference to FIG. 3.

This mechanism comprises an axial control rod 54 situated between the handle 6 and a cam 60, and guided in translation along its own axis by bearings 62.

The axial control rod 54 thus makes it possible to drive the cam 60 (described in detail hereinafter) in a translational movement identical to the movement imparted by the user to the handle 6.

The mechanism also comprises two transverse control rods 56, 58 each connecting the cam 60 to a latch 5. Each transverse control rod 56, 58 is guided in a translation by means of bearings 64 in the direction of movement of the latches 5, i.e. here a direction perpendicular to the axial control rod 54.

A spring 66 is moreover mounted on each transverse control rod 56, 58, between the cam 60 and the bearing 64.

The cam 60 comprises two cam paths 68 each of which cooperate with a pin 70 firmly fixed to a transverse control rod 56, 58. Each cam path 68 comprises a first portion formed of an inclined face, here at 45°, and a second portion having a slight indentation in the direction of retraction of the corresponding lateral control rod 56, 58.

As already stated, FIG. 5 shows the mechanism in its position in which each of the latches 5 is retracted (i.e. returned) into the T-assembly 4.

The user then pushes in the handle along the arrow U shown in FIG. 5, driving the displacement of the axial control rod 56, and therefore of the cam 60, in translation in the same direction.

The movement of the cam 60, due to the displacement of the pins 70 in the cam paths 60 (in particular here the faces at 45°), causes the movement of the pins 70 and therefore of the transverse control rods 56, 58 along the axis of said control rods and outwards for each of them, i.e. in the direction of deployment of the latches 5 of the T-assembly 4.

It is noted that this movement is accompanied by the compression of the springs 66.

Figure 7B:
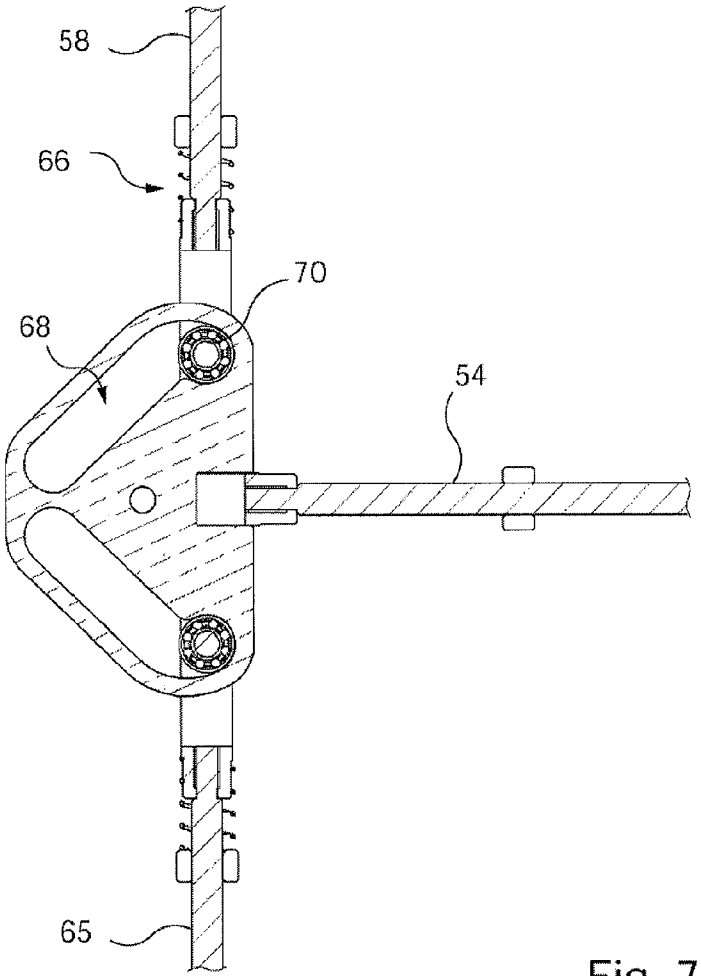
FIG. 7B is a detailed view of a cam of the mechanism in FIG. 6.

The movement continues until the pin 70 reaches the level of the portion of the cam path 68 forming an indentation, in which the pin 70 will be immobilized under the effect of the compression of the spring 66 (which acts to keep the pin 70 in the indentation), as shown in the detailed view in FIG. 7B.

The deployed position of the latches 5 is thus achieved, as shown in FIG. 6. This position is stable due to the pins 70 being immobilized in the indentations.

In order to provide additional safety, a mechanism to lock the handle 6 in its position corresponding to the deployed position of the latches 5 is used here. The mechanism is shown in FIG. 7A.

Said mechanism comprises a rod 104 guided by a brace 108 and kept in contact with the handle 6 (i.e. here downwardly) by a spring 102.

The upper part of the rod 104 bears a gripping device 106.

Figure 7A:
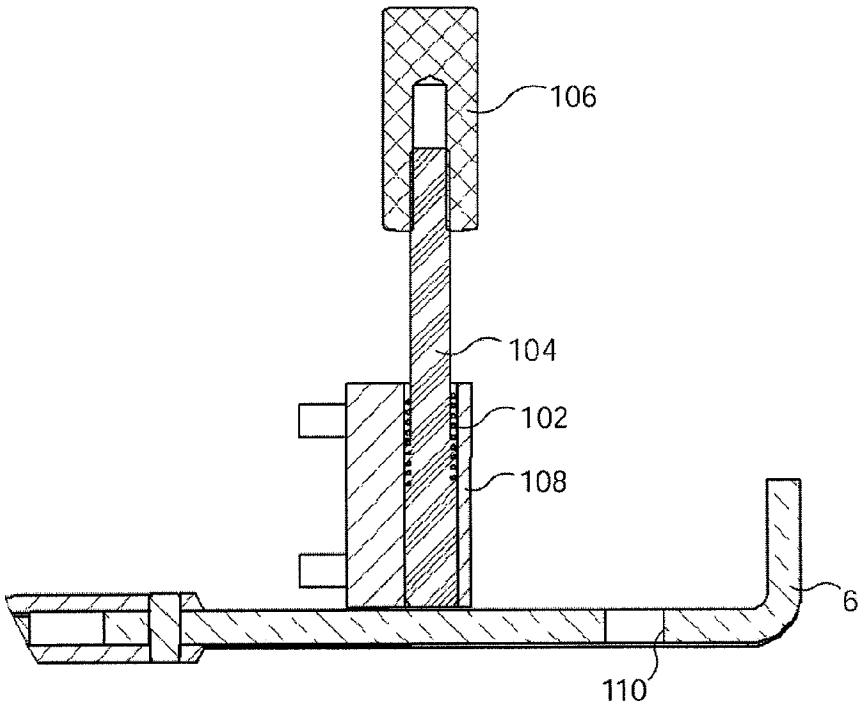
FIG. 7A is a detailed view of the mechanism shown in FIG. 5 showing in cross-section a handle locking mechanism.

In its position shown in FIG. 7A (which corresponds to the foremost position of the handle 6 and therefore to the retracted position of the latches), the lower portion of the rod 104 rests on the upper face of the handle 6.

When the handle 6 is pushed forwards to reach the deployed position of the latches 5 as explained above, the rod is aligned with a hole 110 provided in the handle 6 and is inserted automatically into this hole 110, thus locking the handle 6 in its foremost position.

In addition to the application of a force against the springs 66 as already explained, returning the handle 6 to its rearmost position however requires the user to lift the rod 104 (by means of the gripping device 106) in order to remove it from the hole 110 and thus unlock the handle 6.

It is noted that, as already disclosed with reference to FIG. 3, in the deployed position the latches 5 allow two cabinets to be locked together and an axis of rotation between the cabinets to be defined, corresponding to the axis linking the latches 5.

Finally it is noted that the force keeping the pins 70 in the indentations of the cam paths 68 is designed so as to allow the pins 70 to leave the corresponding indentations when the user operates the handle 6 rearwards (i.e. in order to return from the position shown in FIG. 6 to the position shown in FIG. 5).

Figure 8:
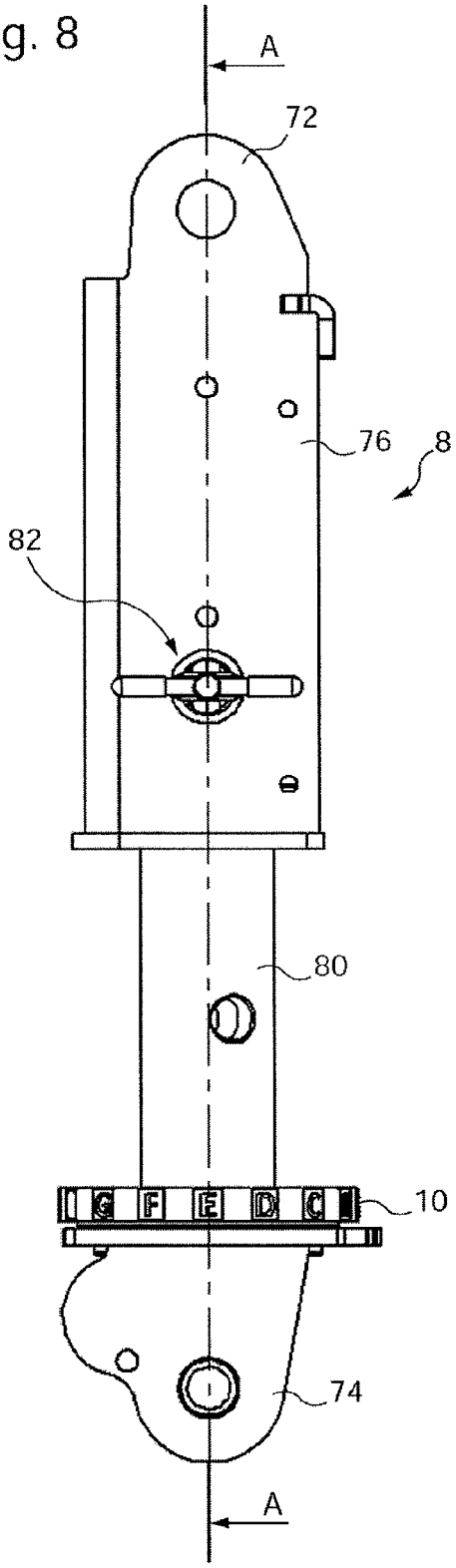
FIG. 8 is a side view of the piston with which the cabinet in FIG. 1 is equipped, in the adjustment position.
Figure 9:
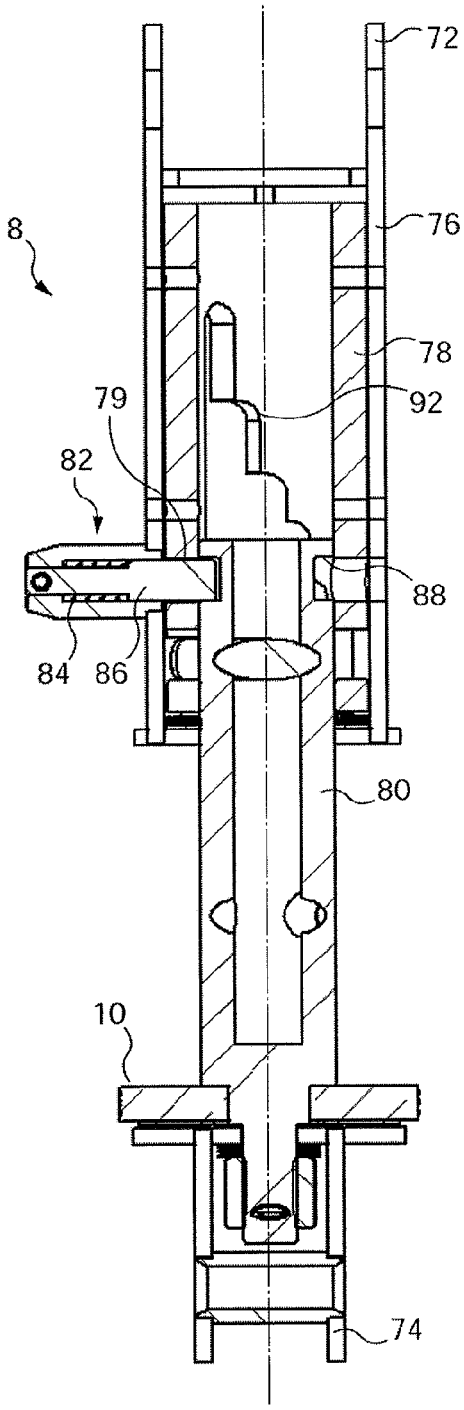
FIG. 9 shows a cross-section of the piston in FIG. 8 between the arrows A-A.
Figure 10:
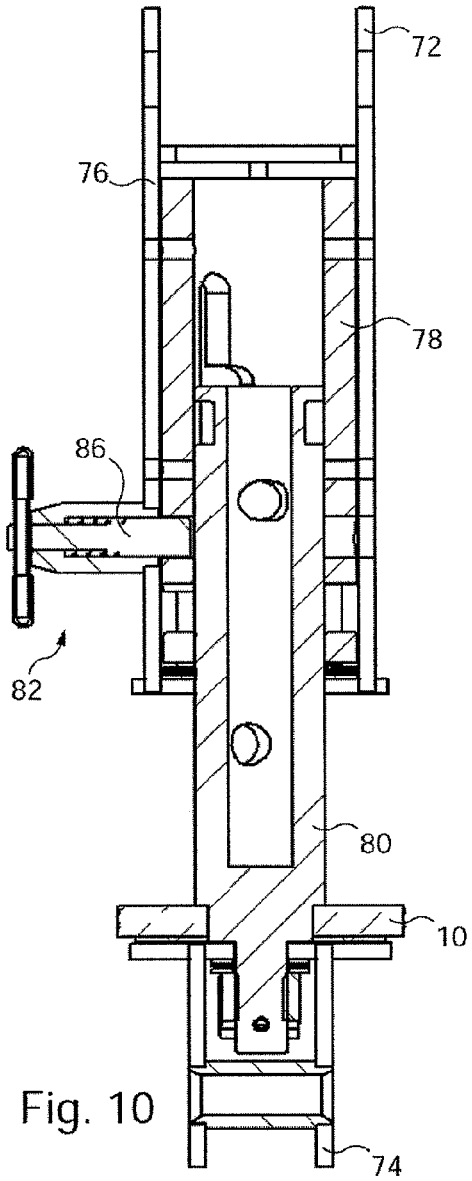
FIG. 10 shows a cross-section of the same type, the piston being this time in the operating position.

FIGS. 8 and 9 show the piston 8 in the adjustment or transport position, which corresponds to the position of maximum extension of the piston.

The piston 8 comprises an upper attachment point 72 and a lower attachment point 74.

The upper attachment point 72 is firmly fixed to the body 78 of the piston; the upper attachment point 72 is here produced in a single piece with a casing 76 surrounding the body 78 and firmly fixed thereto.

The body 78 forms the female part of the piston 8, while the male part is formed by a rod 80 slidably mounted in the body 78 and bearing the lower attachment point 74.

A control lever 82 is mounted on a side wall of the casing 76 and comprises a latch 86, slidably mounted in a direction perpendicular to the axis of the piston 8 and constantly driven towards the axis thereof by means of a spring 84 mounted in the control lever 82.

It is noted that the latch 86 is slidably mounted not only through a suitable opening of the casing (on which the control lever 82 is mounted) but also through a cylindrical bore 79 formed in the body 78.

By acting against the force generated by the spring 84, the user can manoeuvre the latch 86 into various positions along its axis as explained hereinafter.

In the position shown in FIGS. 8 and 9, the latch 86 (under the effect of the spring 84) enters a circumferential recess 88 formed on the circumference of the rod 80 in its upper portion (i.e. the portion situated on the side of the upper attachment point 72).

The rod 80 is thus in a predefined longitudinal position with respect to the body 78, determined by the relative positioning of the latch 86 and the circumferential recess 88. Because the circumferential recess 88 is situated in the upper portion of the rod 80, this position corresponds to the maximum extension used of the piston 8.

In this position, the user can turn the toothed wheel 10, firmly fixed to the rod 80 (in particular rotatably about the axis of the piston 8) to a desired position, for example marked by a given letter.

In so doing, the user adjusts the angular position of the rod 80 about its axis, and therefore in particular with respect to the body 78 (rotatably fixed with respect to the cabinet). It is noted in this respect that the rod 80 and the toothed wheel 10, firmly fixed to each other, are mobile in rotation with respect to the lower attachment point 74.

Starting from the position shown in FIG. 9, the user can pull on the control lever 82 in order to make the latch 86 leave the recess 88, releasing the translational movement of the rod 80 in the body 78.

This movement is possible until a pin 90 borne by the rod 80 engages with a surface of a profile 92 provided on the body 78, as now explained in greater detail.

Figure 11:
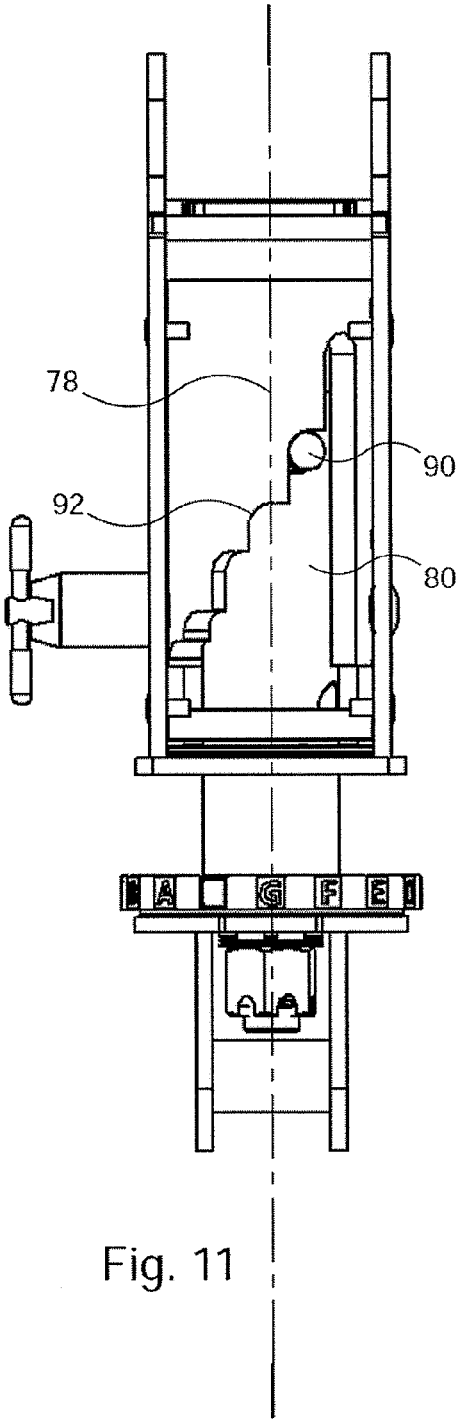
FIG. 11 shows a cross-section of the compressed piston in a particular adjustment.
Figure 12:
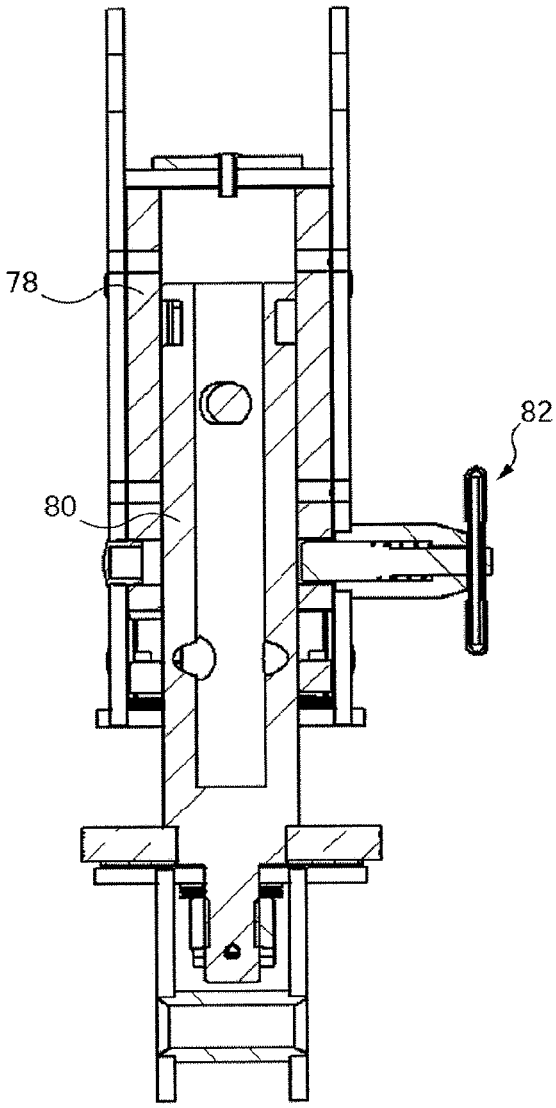
FIG. 12 shows another cross-sectional view of the piston in FIG. 11.

The piston length in compression is determined (during the compression movement of the piston after assembly of the cabinets as explained below) by the longitudinal position in which the pin 90 of the rod 80 abuts on the profile 92 borne by the body 78, as for example in its position shown in FIGS. 11 and 12.

Figure 13:
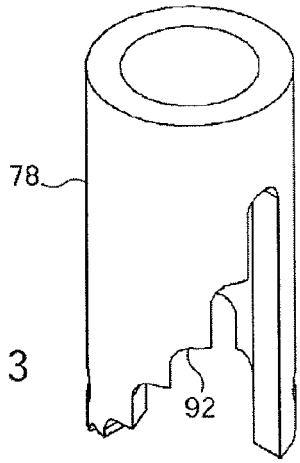
FIG. 13 is a detailed view of the body of the piston.

Due to the particular shape of the profile 92 (see in particular the perspective view of the body 78 in FIG. 13), the longitudinal position of the rod 80 in which the pin abuts on the profile 92 depends on the relative angular position of the body 78 and the rod 80, said position being pre-adjusted by the user as explained above with reference in particular to FIGS. 8 and 9.

Figure 2:
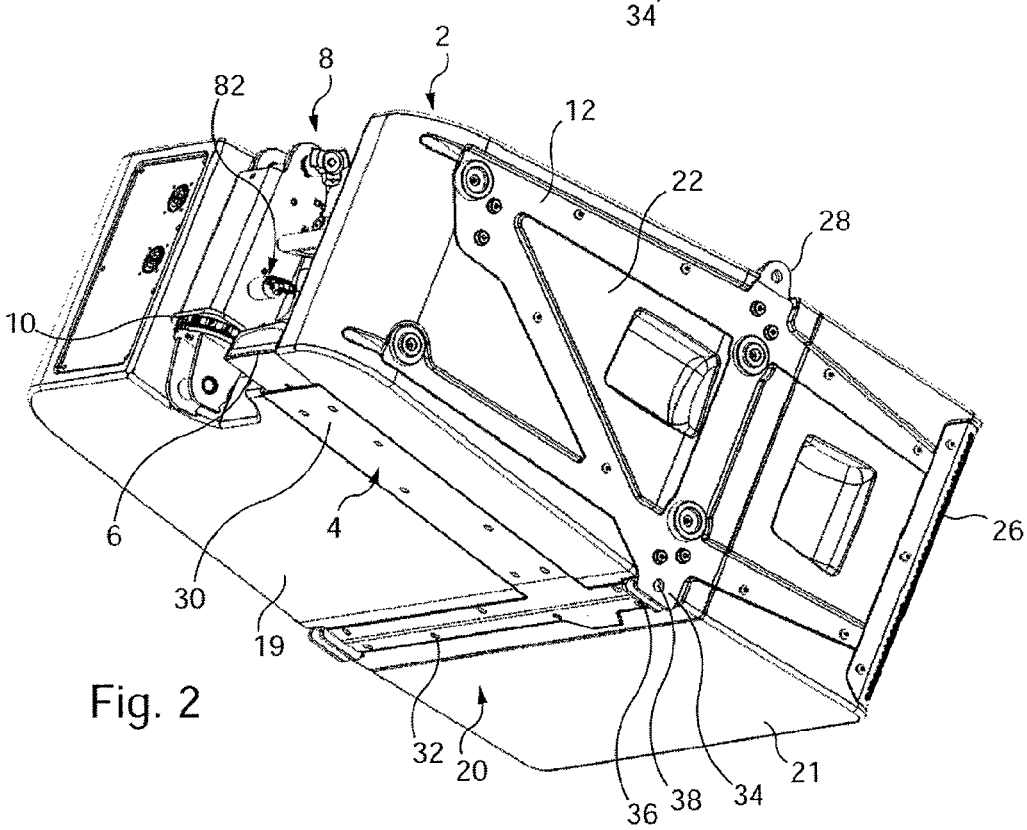
FIG. 2 is another perspective view of the cabinet in FIG. 1.
Figure 14:
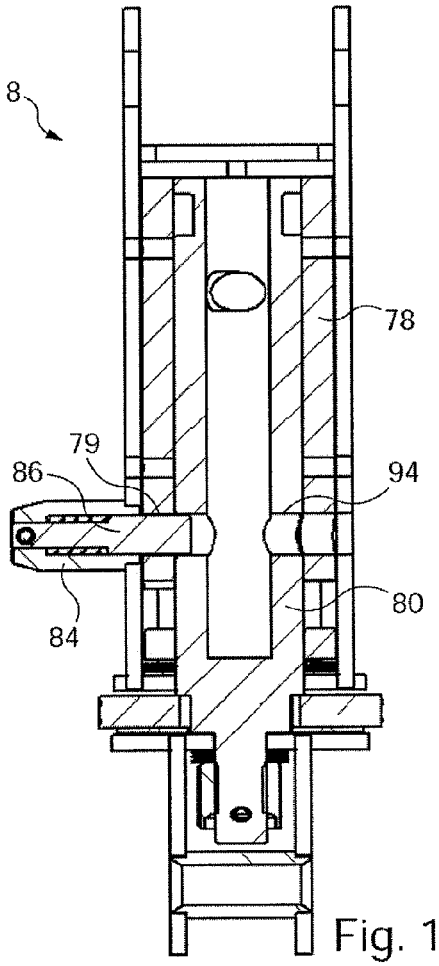
FIG. 14 shows the piston in the retracted position.

FIG. 14 shows the piston 8 in a retracted (or stored) position in which it occupies a minimum volume, as shown moreover in FIGS. 1 and 2.

The rod 80 comprises a cylindrical bore 94 (the axis of which is perpendicular to the main axis of the rod 80) which, when the rod 80 is completely retracted into the body 78 and in a particular angular position of the rod 80 with respect to the body 78, is positioned level with the cylindrical bore 79 through which the latch 86 passes as already explained.

Thus, when the user positions the toothed wheel 10 in a suitable position, for example duly labelled for this purpose, and presses the rod 80 into the body 78 (for example by grasping the lower attachment point 74 and lifting it), the latch 86 enters the cylindrical bore 94 of the rod 80 under the pressure of the spring 84 and thus immobilizes the rod 80 longitudinally in the body 78, defining the abovementioned retracted fixed position.

A procedure will now be described for rigging a set of cabinets according to the teaching of the invention.

Figure 15:
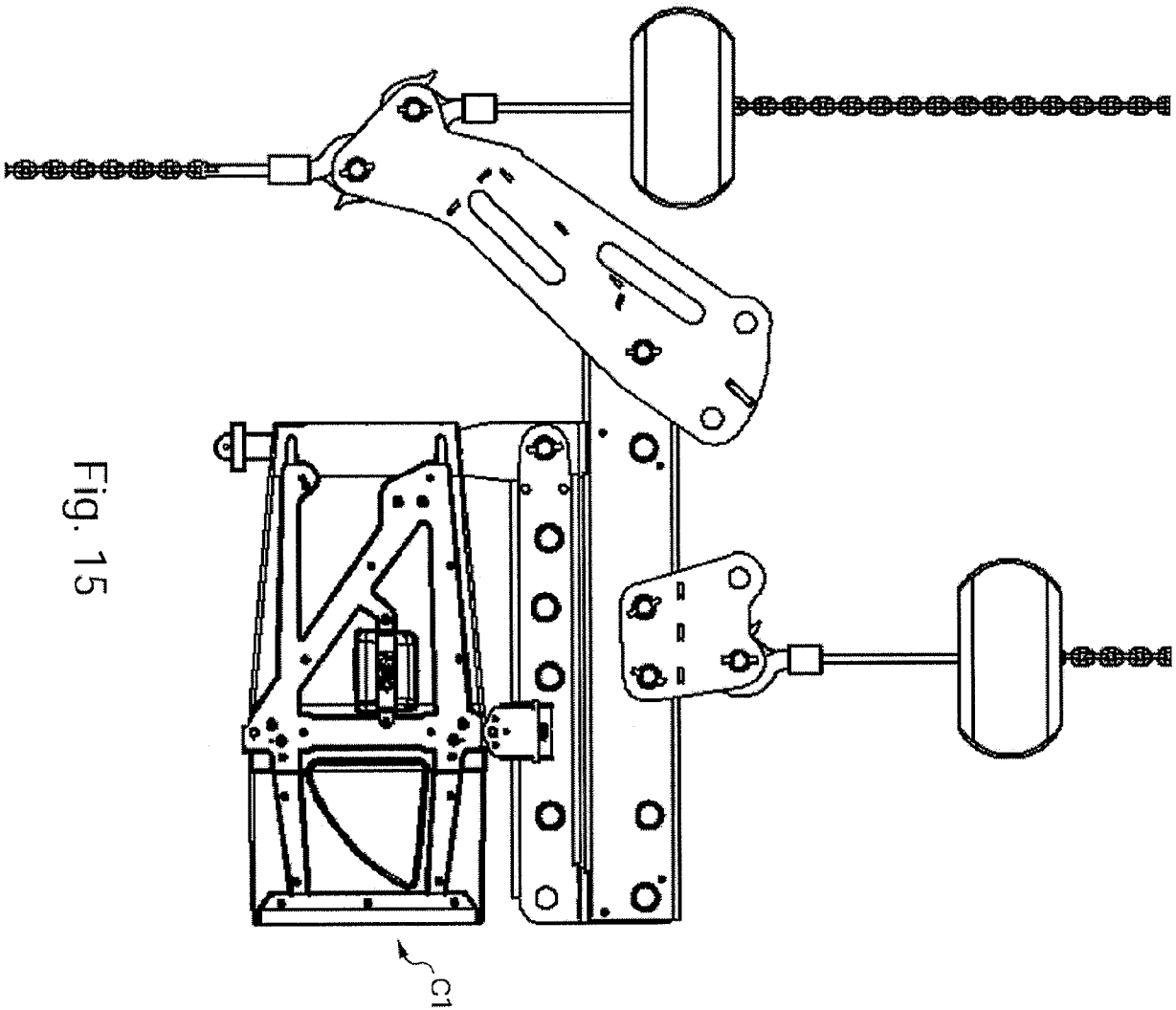
FIG. 15 shows a first step of an assembly process in which a first cabinet is mounted on a bumper.

FIG. 15 shows a first cabinet C1 connected to its bumper, which is itself connected to two hoisting motors.

Figure 16:
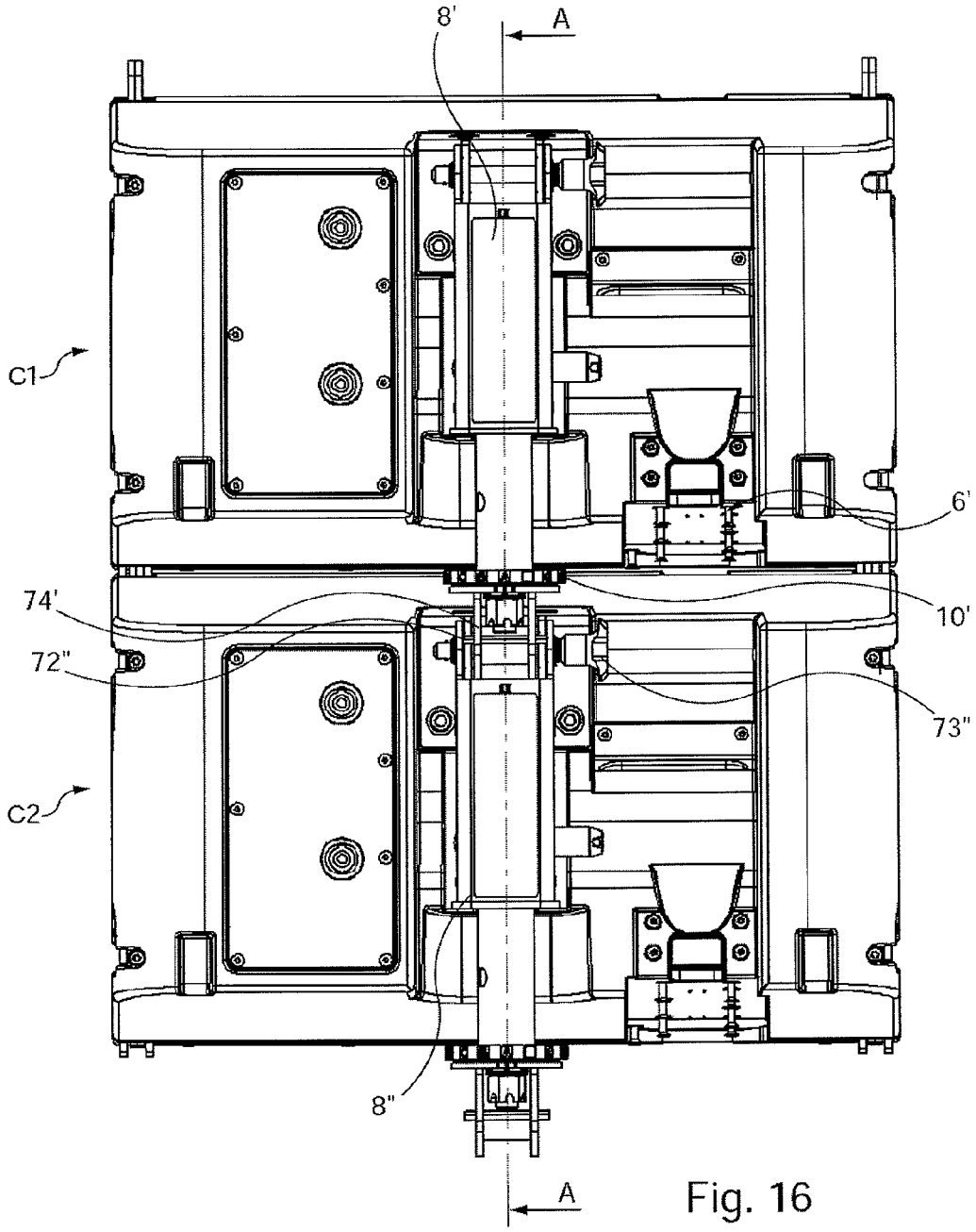
FIG. 16 shows the assembly of two cabinets according to the teaching of the invention.
Figure 17:
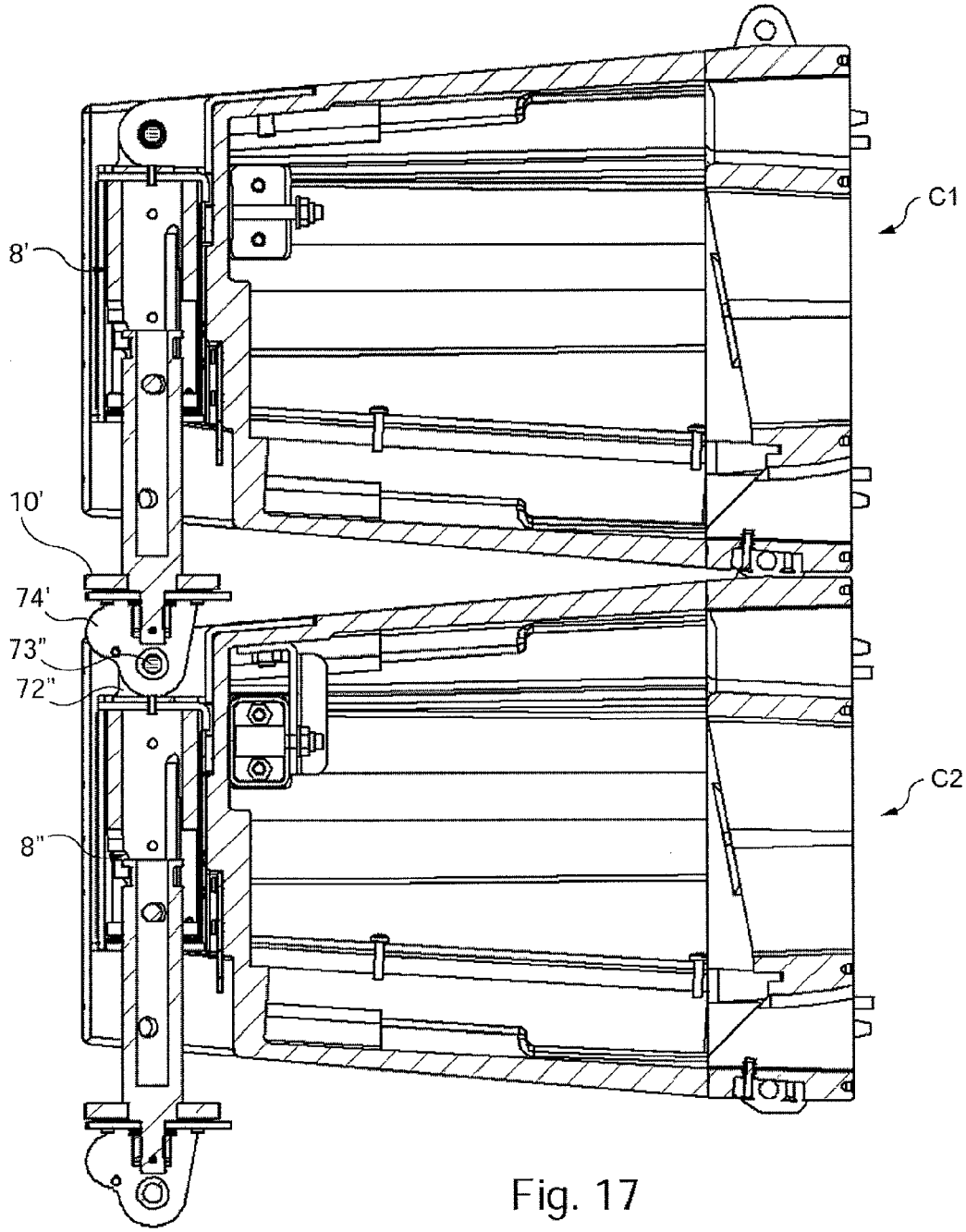
FIG. 17 is a cross-sectional view of the assembly in FIG. 16.

FIGS. 16 and 17 show how a second cabinet C2 is connected to the first cabinet C1.

The procedure for assembling these two cabinets is for example the following:

- the first cabinet C1 is prepared by positioning the piston 8' of this cabinet in its adjustment position (shown in FIGS. 8 and 9) and adjusting its toothed wheel 10' to the chosen position;
- the ball lock 73" mounted on upper attachment point 72" of the piston 8" of the second cabinet C2 is removed;
- the second cabinet C2 is positioned below the first cabinet C1 by aligning them as already stated (i.e. by aligning the hinge line C of the second cabinet C2 with the axis of the latches of the first cabinet C1);
- the handle 6' of the connection mechanism of the first cabinet C1 is moved forwards, allowing the cabinets C1, C2 to be linked together as already explained with reference to FIG. 3;
- the ball lock 73" is mounted through the upper attachment point 72" of the piston 8" of the second cabinet C2 and through the lower attachment point 74' of the piston 8' of the first cabinet C1.

Figure 18:
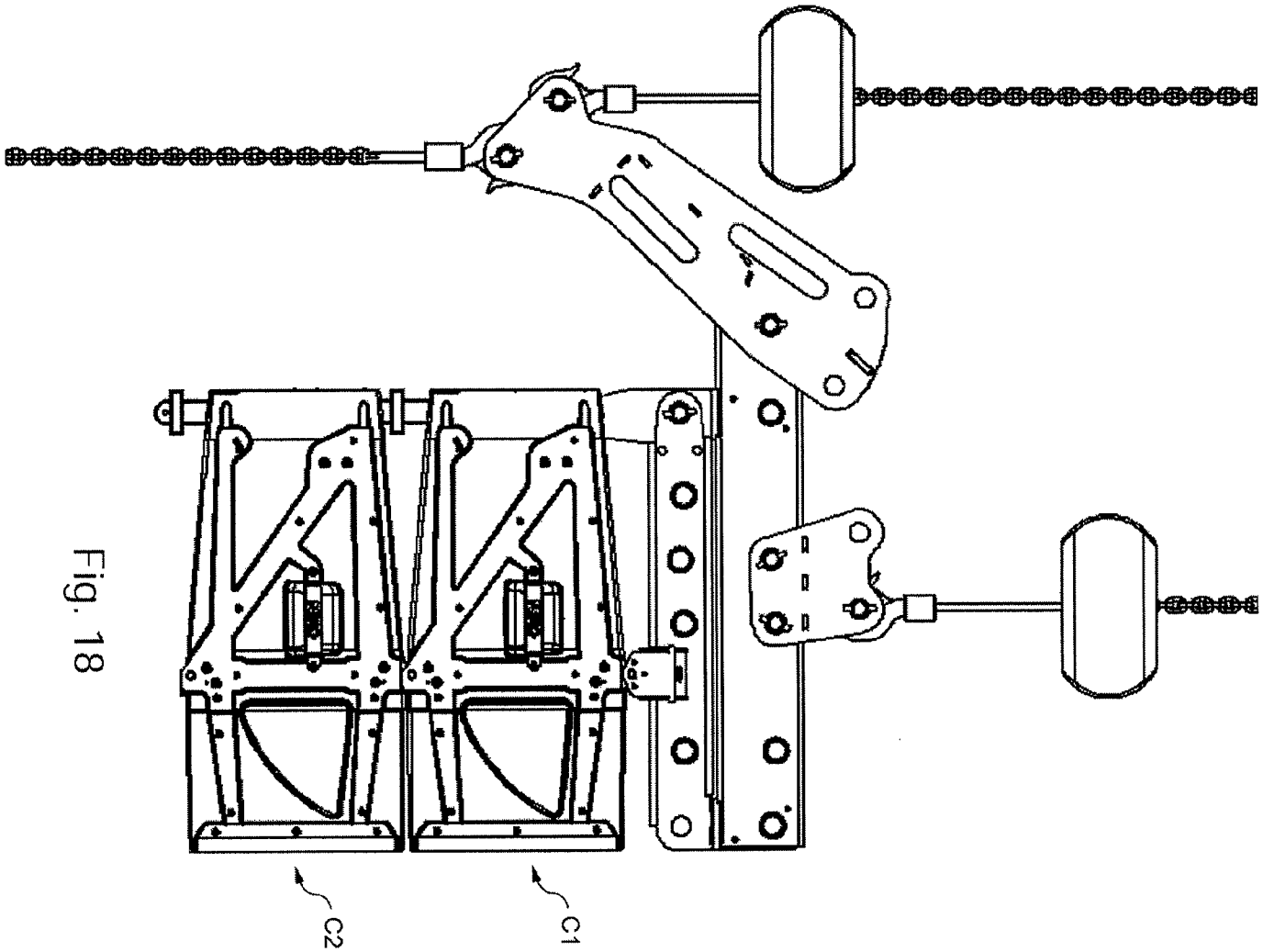
FIGS. 18 to 20 show the subsequent steps of the process of assembling a plurality of cabinets, carried out according to the teaching of the invention.

The new assembly thus constituted is lifted by means of the hoisting motors, as shown in FIG. 18, in order to receive the next cabinet.

Figure 19:
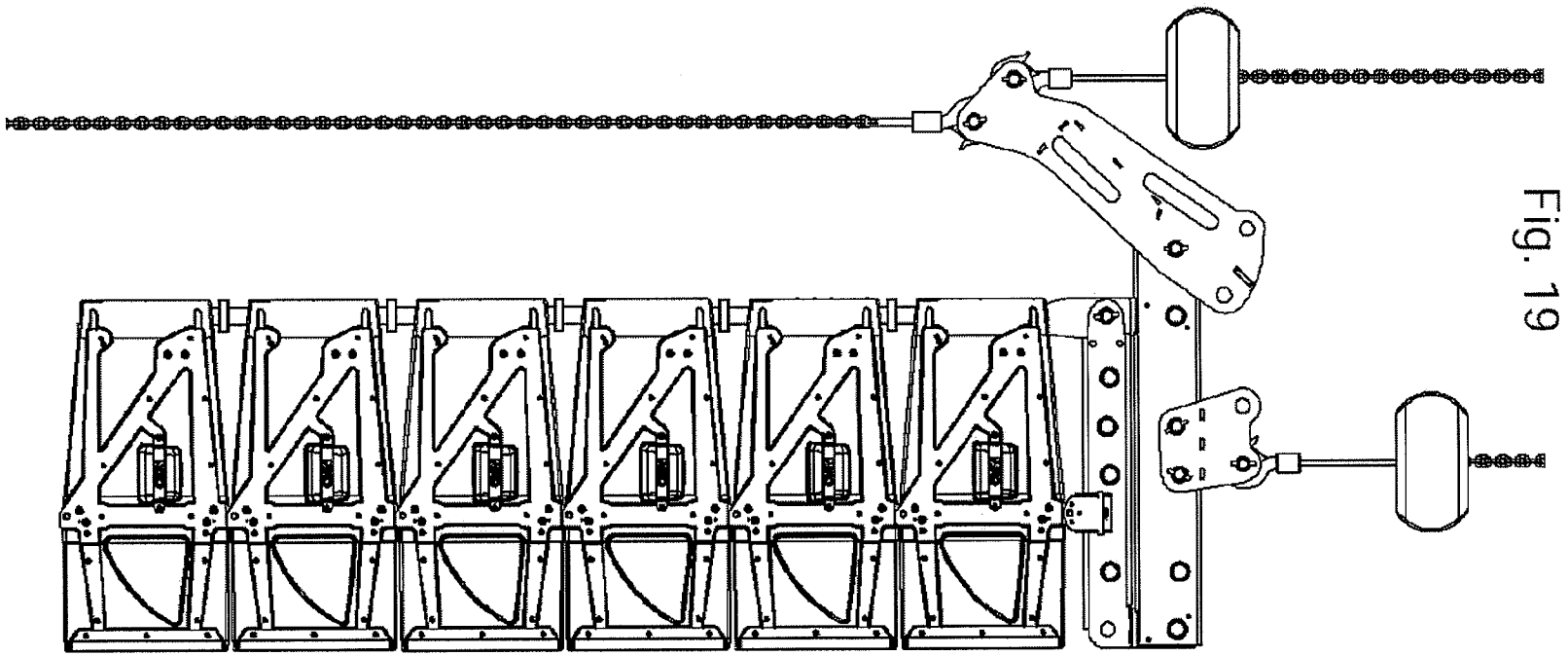

This procedure is repeated for each of the cabinets to be added, so that a plurality of assembled cabinets is obtained as shown in FIG. 19.

Figure 20:
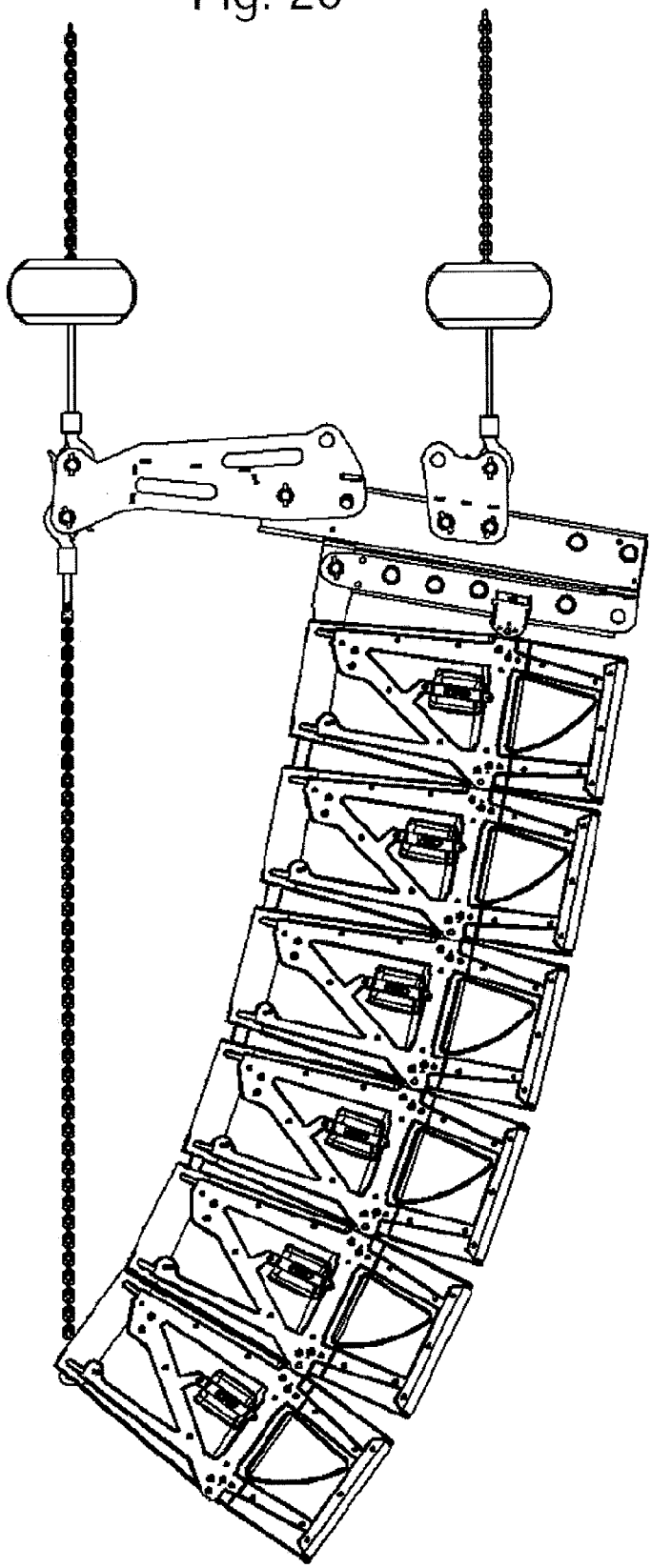

The rear lifting motor, connected to the last cabinet of the plurality (i.e. the lowest cabinet), will compress the assembly so that the pistons are compressed, thus achieving their operating position, and the inter-cabinet angles between adopt their final values, determined by the adjustment of the toothed wheels, as shown in FIG. 20.

The system can then be lifted to its final height.

It is noted that this so-called "compression" rigging method has the advantage of removing the need to lift the rear of the successive cabinets in order to adjust the angles: the cabinets rise vertically, and the hoisting motors give the assembly its final configuration.

The dismantling procedure is carried out in reverse with respect to the mounting procedure with the difference that disconnecting the cabinets requires a specific action by the operator on the locking mechanism, as explained above.

Figure 21:
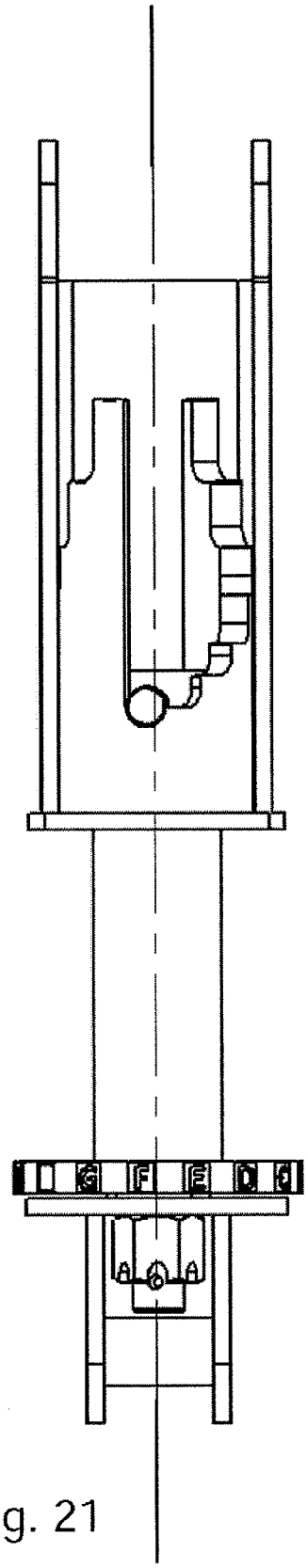
FIGS. 21 and 22 are figures of the type of FIG. 11, in the case of a variant embodiment and for different adjustments.
Figure 22:
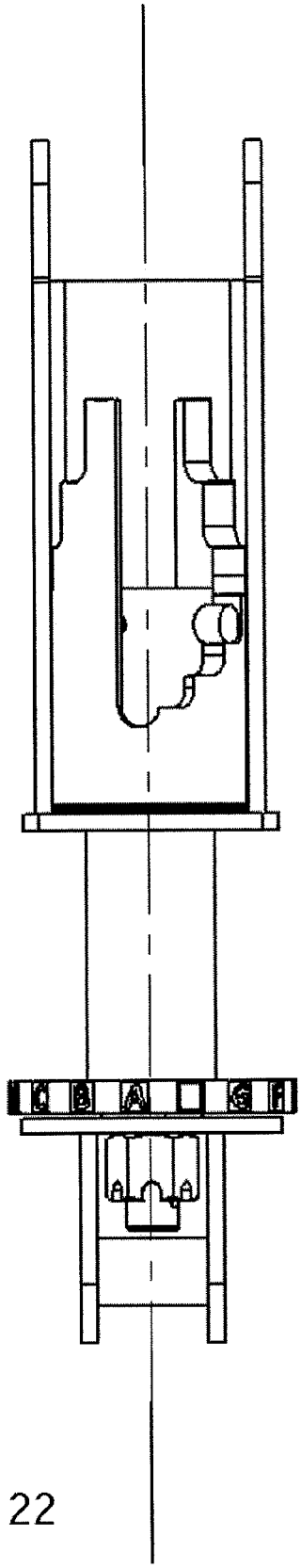

The angle adjustment system proposed by the invention is however equally applicable when a tension rigging method is used. However in this case a piston will be used as shown in FIGS. 21 and 22 in which the angular position of the rod (adjusted using a toothed wheel as previously) determines the extended piston length (not the compressed length as in the above-described example).

Moreover, the examples given above are merely possible, non-limitative, embodiments of the invention.

The invention claimed is:

1. A loudspeaker cabinet comprising:

a device for mechanical connection to another loudspeaker cabinet, the connection device comprising a metal plate provided at one side of the loudspeaker cabinet, the metal plate having an upper part configured to be fit into a lower part of the other loudspeaker cabinet, a plurality of lugs mechanically coupled to the metal plate, the plurality of lugs each including a hole defined therethrough;

a pair of parallel tabs configured to receive and house a first latch deployed in an extended position, the latch deployed in the extended position passing through a hole of a lug of the other loudspeaker cabinet received between the pair of parallel tabs; and a mechanism configured to convert a translational actuation control in a first direction into a translational movement of the first latch in a second direction different from the first direction.

2. The loudspeaker cabinet according to claim 1, wherein the conversion mechanism is capable of converting the translational actuation into a translational movement of a second latch.

3. The loudspeaker cabinet according to claim 2, wherein the translational movement of the second latch is in the second direction, with a direction opposite to the translational movement of the first latch.

4. The loudspeaker cabinet according to claim 1, wherein the conversion mechanism comprises a cam driven by the actuation control.

5. The loudspeaker cabinet according to claim 4, wherein the cam defines a cam path capable of guiding a pin firmly fixed to the first latch, and the cam path contains an indentation in which the pin is immobilized by a spring.

6. The loudspeaker cabinet according to claim 1, wherein the first direction is essentially perpendicular to the second direction.

7. The loudspeaker cabinet according to claim 1, wherein the actuation control is carried out by a handle, the actuation control comprising an automatic locking mechanism of the handle.

8. The loudspeaker cabinet according to claim 1, further comprising an element having a length of which in an operating position adjusts an angle formed between the cabinet and the other cabinet, the length being determined according to the position of a rotary component.

9. The loudspeaker cabinet according to claim 8, wherein the element is a piston comprising a rod slidably mounted in a body, and the rotary component is a wheel rotatably mounted about a main axis of the piston.

10. Loudspeaker cabinet comprising a device for adjusting an angle formed between the cabinet and another loudspeaker cabinet, characterized in that it comprises an element (8) the length of which in the operating position adjusts said angle and is determined according to the position of a rotary component (10).

11. The loudspeaker cabinet according to claim 10, wherein the element is a piston comprising a rod slidably mounted in a body, and the rotary component is a wheel rotatably mounted about a main axis of the piston.

12. The loudspeaker cabinet according to claim 11, wherein the piston is in compression in the operating position.

13. The loudspeaker cabinet according to claim 11, wherein the piston is in tension in the operating position.

14. The loudspeaker cabinet according to claim 11, further comprising a locking device configured to lock the rod in a position of maximum extension with respect to the body.

15. The loudspeaker cabinet according to claim 11, further comprising a locking device configured to lock the rod in a retracted position within the body.

16. The loudspeaker cabinet according to claim 10, further comprising a retractable shaft configured to connect with the other loudspeaker cabinet.

17. The loudspeaker cabinet according to claim 16, further comprising a mechanism configured to convert a translational actuation control in a first direction into a translational movement of the first latch in a second direction different from the first direction, the retractable shaft comprising the first latch.

* * * * *